US007387470B2

(12) United States Patent
McCracken

(10) Patent No.: US 7,387,470 B2
(45) Date of Patent: Jun. 17, 2008

(54) STACKABLE CONCRETE FORMING APPARATUS COMPONENTS

(76) Inventor: Robert McCracken, 4426 156th, Urbandale, IA (US) 50323

( * ) Notice: Subject to any disclaimer, the term of this patent is extended or adjusted under 35 U.S.C. 154(b) by 0 days.

(21) Appl. No.: 11/433,742

(22) Filed: May 12, 2006

(65) Prior Publication Data

US 2007/0264089 A1 Nov. 15, 2007

(51) Int. Cl.
*E02B 5/16* (2006.01)

(52) U.S. Cl. ..... 405/272; 405/282; 248/354.1

(58) Field of Classification Search ..... 405/282, 405/283, 272, 274; 254/89 H, 133 A; 248/159, 248/161, 354.1
See application file for complete search history.

(56) References Cited

U.S. PATENT DOCUMENTS

| | | | | | |
|---|---|---|---|---|---|
| 503,437 | A * | 8/1893 | Pilcher | 405/282 |
| 587,274 | A * | 7/1897 | Rue | 405/282 |
| 1,061,658 | A * | 5/1913 | Bradshaw | 254/133 A |
| 2,548,844 | A * | 4/1951 | Myers | 254/133 A |
| 3,224,201 | A * | 12/1965 | Brunton | 405/282 |
| 3,851,856 | A * | 12/1974 | Berg | 405/282 |
| 4,221,362 | A * | 9/1980 | Van Santen | 254/133 A |
| 6,467,741 | B1 * | 10/2002 | Shih | 248/354.4 |
| 6,585,231 | B1 * | 7/2003 | Fratoni, Jr. | 405/282 |

* cited by examiner

*Primary Examiner*—Frederick L Lagman
(74) *Attorney, Agent, or Firm*—Kent A. Herink; Emily E. Harris

(57) ABSTRACT

A stackable component for concrete forming systems is described. End plates are secured to opposite ends of a longitudinal element having a round profile that prevents stacking of the components. The end plates nest together and receive for retention the longitudinal element to permit orderly and stable stacking of the components.

3 Claims, 3 Drawing Sheets

STACKABLE CONCRETE FORMING APPARATUS COMPONENTS

BACKGROUND OF THE INVENTION

The invention relates generally to concrete form apparatus and, more specifically, to components of concrete form systems, such as shore posts, that are configures to be stacked in neat and stable arrangements for compact shipping and orderly and safe stacks at work sites.

Concrete forming apparatus is in wide use in the construction of buildings, bridges, and other concrete structures. A common system for forming concrete structures uses a plurality of modular form components that are adapted to be assembled into a wide variety of configurations to conform to virtually any architectural requirement. Such forming apparatus components are typically made of metal so that they are strong enough to support the heavy weight of poured concrete and durable so that the components can be reused many times.

A common-application of concrete forming apparatus is in the formation of elevated sections, such as floors or horizontal beams of a concrete building. Typically, pluralities of modular form panels are assembled to form the surface on which the concrete will be poured. These panels are supported on metal shore posts that typically are constructed of an inner tube that is received for telescopic movement inside an outer tube. Metal tubes achieve high load capacity and the telescoping tubes provide adjustment to various heights. The shore posts typically have a foot pad on the bottom end portion and an adaptable top element on the upper end portion used to releasably secure and support other components of the concrete forming apparatus.

After the new slab of fresh concrete has cured sufficiently, workers remove the shore posts and strip the formwork they supported. Commonly, the shore posts are re-used at the project job site. Between uses, the shore posts are typically stored in an out of the way location. Because of the tubular shape of the shore posts, they do not stack one on top of the other, making it difficult or impossible to make a neat, orderly, compact or stable arrangement of the shore posts. The stacks or piles of shore posts are disorganized and unstable, and may form a safety risk to workers. Once the project is completed, the shore posts must be transported to a new project site. Again, the shape of the shore posts makes it difficult to band together in a stable, compact configuration for shipping and also makes it difficult to count for inventory purposes.

SUMMARY OF THE INVENTION

The preferred embodiment of the present invention consists of a component of concrete forming apparatus having a longitudinal tubular element with top and bottom end elements that intermesh to allow the components to be stacked atop each other in a stable arrangement. In a preferred embodiment consisting of a shore post, the bottom end element is a foot pad or plate and the top end element is an adapter plate. The end plates distribute the load on the shore post and assist in connecting the shore post to other components of the concrete forming apparatus during placement of concrete. While the posts are stored between uses or during transport, the end plates function to provide a stable stack of the tubular shore posts.

In the preferred embodiment, the top end plate is a flat plate having a preselected width and the bottom end plate has a web section with a width slightly larger than the width of the top end plate and a pair of upturned flanges on either side of the web section. Accordingly, the top end plate of a shore post is received inside the flanges of the bottom end plate of an adjacent shore post. In addition, notches are formed in the perimeter of the end plates to provide a receptacle for the tubular elements of adjacent shore posts. In a stack of shore posts, the posts are arranged parallel to each other in an alternating top-for-bottom pattern. The round tubes of an upper shore post rest in the notches of the end plates of the next lower shore post and the side flanges of both bottom end plates keep the upper post from sliding or rolling off of the lower shore post. This provides the novel ability to stack multiple tubular components vertically in a column. The neatly stacked components are stable, easy to inspect, easy to count, compact, and easy to bundle for transport.

An object of the present invention is to provide round or tubular concrete forming apparatus components with end elements which cooperate to permit the components to be arranged in neat, stable, and compact stacks.

Another object of the present invention is to provide a shore post with top and bottom end plates that interact with adjacent shore posts to permit the shore posts to be arranged in neat, stable, and compact stacks.

A further object of the invention is to provide an arrangement of a plurality of concrete forming apparatus components such that stacks of the components at a job site are neat and stable, can be easily inspected and counted, and can be easily bundled together for transport These and other objects will be understood by those skilled in the art upon a review of this specification, the associated figures and the appended claims.

DETAILED DESCRIPTION OF PREFERRED EMBODIMENTS

Figure 1:
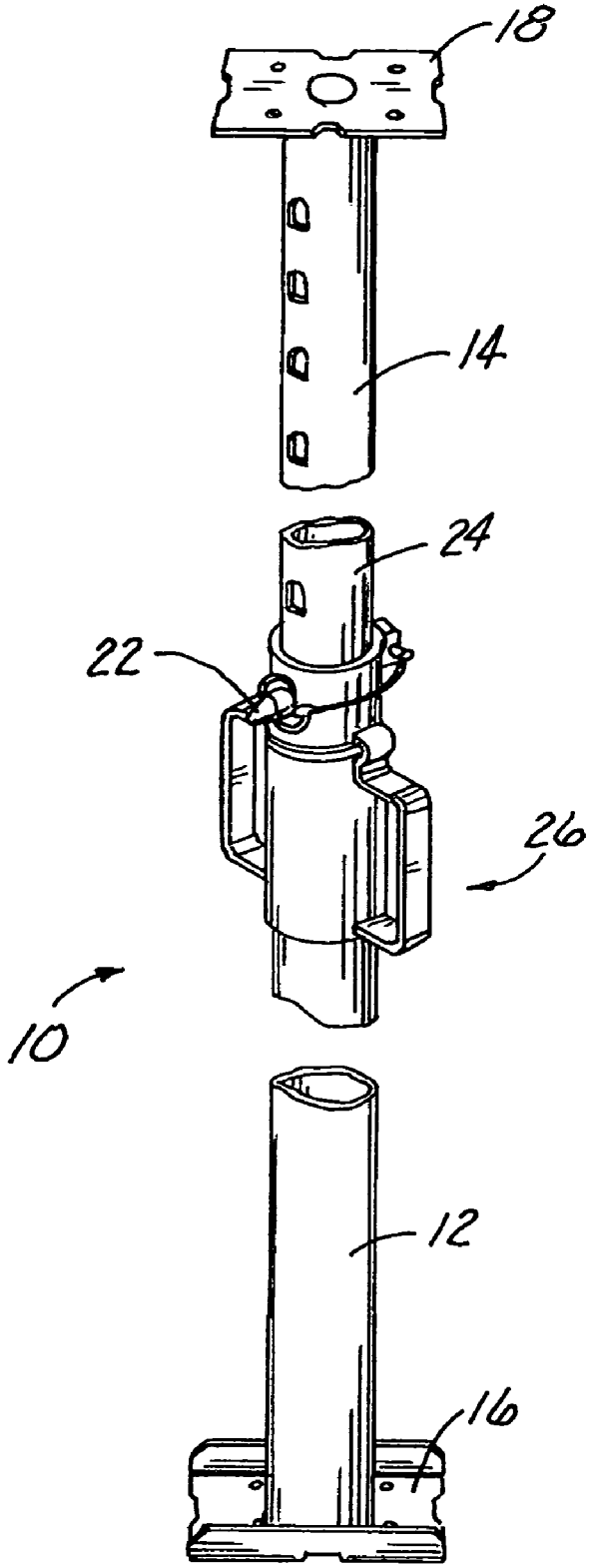
FIG. 1 is elevational view of a shore post representing a preferred embodiment of the present invention.

Illustrated in FIG. 1, generally at 10, is a shore post representing a preferred embodiment of the present invention. The shore post 10 includes an outer telescoping tube 12, an inner telescoping tube 14, a bottom end plate or foot pad 16 and a top end plate or adapter plate 18. The shore post 10 may be telescopically adjusted in length between a foreshortened or collapsed position and an lengthened or extended position. The shore post 10 may be set at a plurality of adjusted lengths by use of a pin 20 that is inserted into a pair of diametrically opposed holes in the outer tube 12 and a selected pair of a plurality of holes 22 in the inner tube 14 spaced at a regular interval. Fine adjustment of the length of the shore post 10 is made by rotation of a threaded linkage member 24. Rotation of the linkage member 24 is facilitated by a pair of diametrically opposed handles 26 and 28 which extend radially from the linkage member 24.

Figure 3:
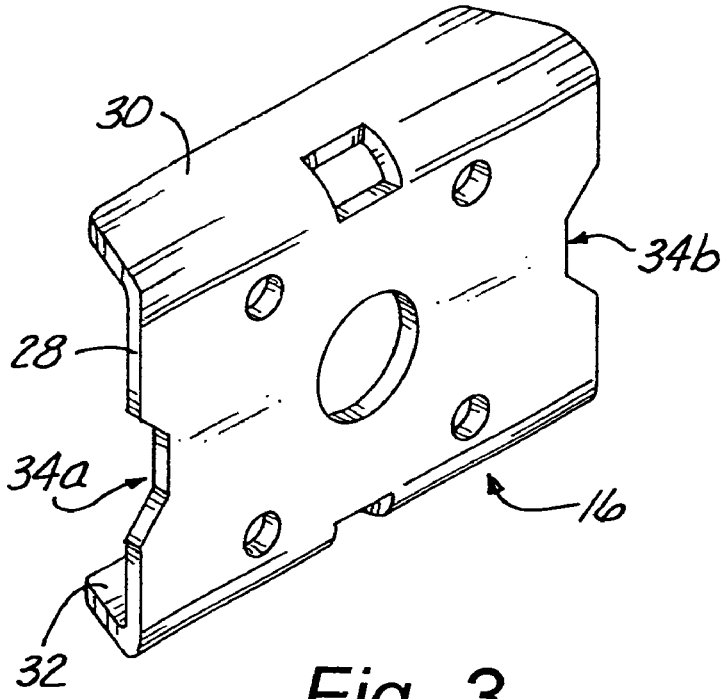
FIG. 3 is an enlarged perspective view of a foot pad of a preferred embodiment of the present invention.
Figure 4:
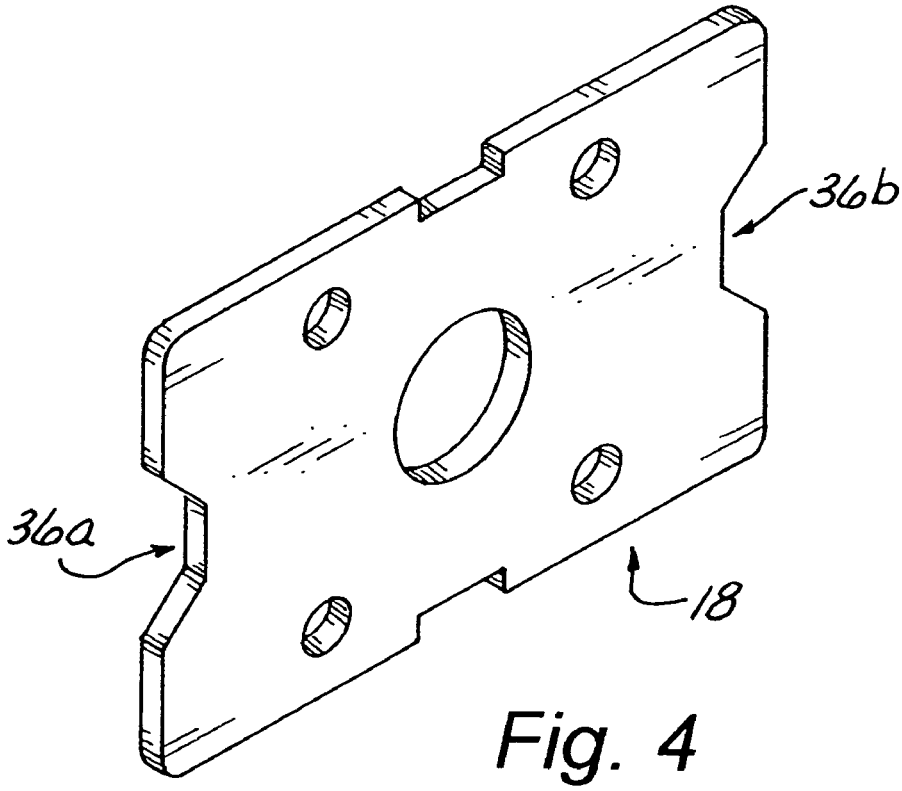
FIG. 4 is an enlarged perspective view of a top end plate of a preferred embodiment of the present invention.

The top end plate 18 is a flat plate of a preselected width and having a pair of notches 30 and 32 formed in opposing ends (FIG. 4). The notches 30,32 are preferably in the shape of a trapezoid. The corners of the trapezoid provide two contact points to the tubes of the post stacked above. The contact points are spread apart to provide a stable support to the above member The foot pad or bottom end plate 16 has a central web section 34 and an upturned flange 36, 38 formed on either side of the web section 34 (FIG. 3). The web section 34 is of a width slightly larger than the width of the top end plate 18. A pair on notches 40, 42 are formed in opposing ends of the web section 34 corresponding to the notches 30, 32 of the top end plate 18.

Figure 2:
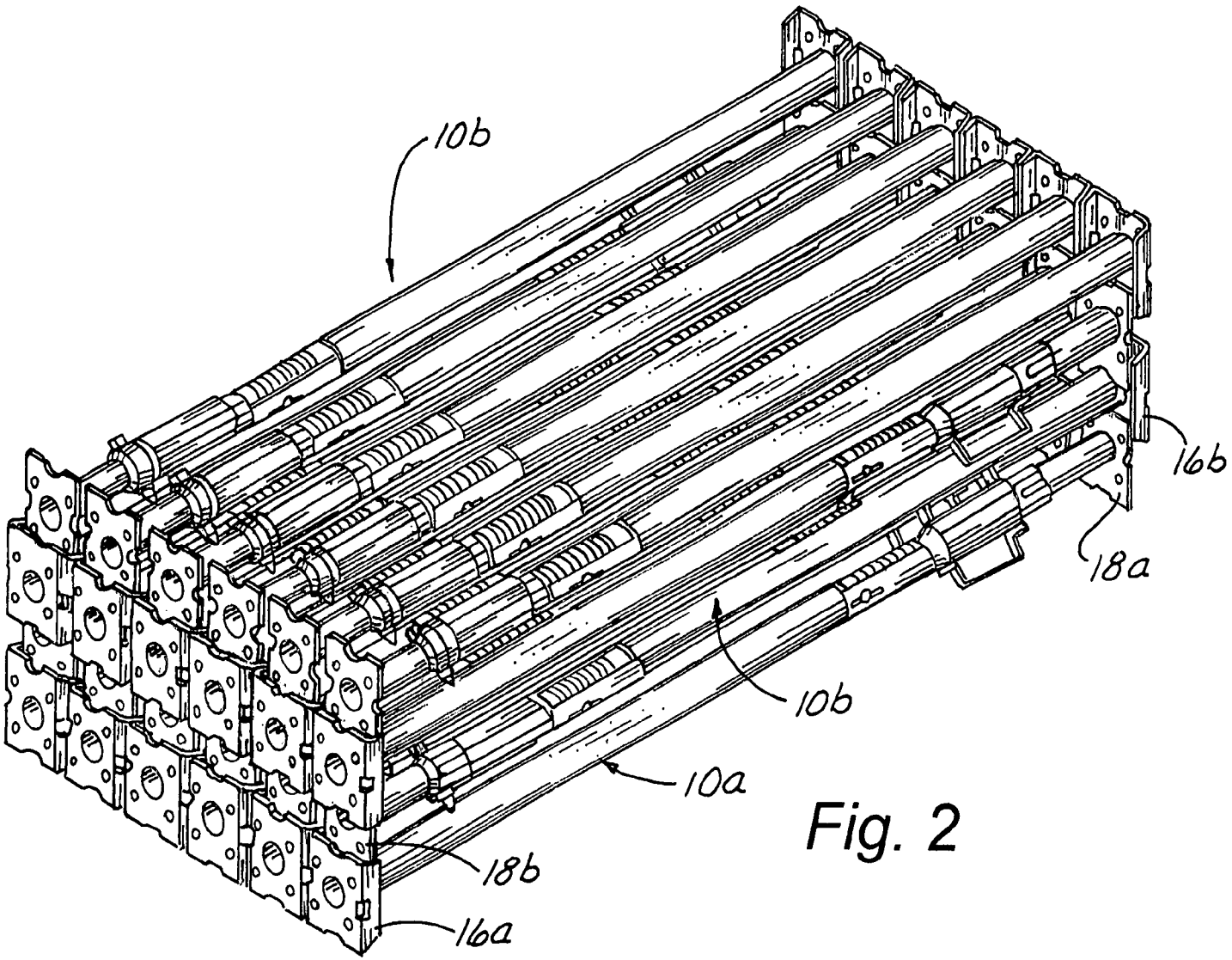
FIG. 2 is a perspective view of a plurality of shore posts of FIG. 1 arranged in a stack.

To arrange a plurality of shore posts 10 in a stack, a first shore post 10*a* (FIG. 2) is placed on the floor or other supporting surface. A second shore post 10*b* is oriented top-to-bottom relative to the first shore post 10*a* and placed on top of the first shore post 10*a* with the top end plate 18*b* adjacent the web section 34*a* and between the flanges 36*a*, 38*a* at one end and with the top end plate 18*a* adjacent the web section 34*b* and between the flanges 36*b*, 38*b* at the other end. Note that the outer tube 12*b* of the top shore post 10*b* rests in the notch 30*a* of the bottom shore post 10*a*, and similarly, the notch 32*b* of the top end plate 18*b* of the top shore post 10*b* rests on the outer tube 12*a* of the bottom shore post 10*a*. The end plates 16*a*, 16*a* stably support the bottom shore post 10*a* and the flanges 36, 38 of each of the bottom end plates 16*a*, 16*b* prevent the top shore post 10*b* from rolling off of the bottom shore post 10*a* by limiting movement of the top end plates 18*a*, 18*b*. In this way, stable stacks of multiple shore posts can be created. In a preferred arrangement illustrated in FIG. 2, twenty-four shore posts are arranged in a stack six wide and four tall. Note that the handles 26, 28 have been adjusted at an angle relative to the stacked arrangement so as not to interfere with the tubes or handles of adjacent shore posts.

While the invention has been described with respect to a shore post as the preferred embodiment, the invention is applicable other tubular form components such as wall form pipe braces as well as to components formed of solid round bars, such as taper ties.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

I claim:

1. A stack of a plurality of components, comprising:

(a) a first end plate attached to a first end of the longitudinal member and having a notch formed in a peripheral edge to accommodate the round profile;

(b) a second end plate attached to a second, opposite end of the longitudinal member and having a notch formed in a peripheral edge to accommodate the round profile;

(c) flanges formed in opposing edges of the second end plate spaced to accommodate the first end plate, (d) a first component supported horizontally on the two end plates;

(e) a second component supported on the first component having the first end plate of the second component received between the flanges of the second end plate of the first component and the notches of the first and second end plates of the second component resting on and supported by the longitudinal element of the first component; and (f) the first end of the first component is received between the flanges of the second end plate of the second component.

2. A stack of components as defined in claim 1, wherein the longitudinal member of the first and second components comprises telescoping tubes of a shore post.

3. A stack of components as defined in claim 2, wherein the telescopic tubes of the first and second components are adjusted to the same length.

* * * * *